US012644356B2

(12) United States Patent
Wang et al.

(10) Patent No.: US 12,644,356 B2
(45) Date of Patent: Jun. 2, 2026

(54) HIGHLY-SEALED RETRIEVABLE ANCHORING PACKER

(71) Applicant: CHINA UNIVERSITY OF PETROLEUM-BEIJING, Beijing (CN)

(72) Inventors: Yanbin Wang, Beijing (CN); Deli Gao, Beijing (CN); Lantao Lyu, Beijing (CN)

(73) Assignee: CHINA UNIVERSITY OF PETROLEUM—BEIJING, Beijing (CN)

( * ) Notice: Subject to any disclaimer, the term of this patent is extended or adjusted under 35 U.S.C. 154(b) by 0 days.

(21) Appl. No.: 19/239,288

(22) Filed: Jun. 16, 2025

(65) Prior Publication Data

US 2026/0009306 A1 Jan. 8, 2026

(30) Foreign Application Priority Data

Jul. 2, 2024 (CN) ..... 202410882686.5

(51) Int. Cl.
*E21B 33/128* (2006.01)
*E21B 33/129* (2006.01)

(52) U.S. Cl.
CPC ..... *E21B 33/128* (2013.01); *E21B 33/1293* (2013.01)

(58) Field of Classification Search
CPC .. E21B 33/128; E21B 33/1285; E21B 33/129; E21B 33/1291; E21B 33/1292; E21B 33/1293; E21B 33/1295
See application file for complete search history.

(56) References Cited

U.S. PATENT DOCUMENTS 2,791,278 A * 5/1957 Clark, Jr. ..... E21B 33/1216 166/134
2019/0226327 A1* 7/2019 Telfer ..... E21B 23/0411

FOREIGN PATENT DOCUMENTS

| | | | |
|---|---|---|---|
| CN | 105545246 | A | 5/2016 |
| CN | 105781483 | A | 7/2016 |
| CN | 108915633 | A | 11/2018 |
| CN | 111622708 | A | 9/2020 |
| CN | 111734340 | B | 11/2020 |
| CN | 212837679 | U | 3/2021 |
| CN | 111119785 | B | 5/2022 |

(Continued)

OTHER PUBLICATIONS

Chinese Office Action for CN202410882686.5 Dated Nov. 1, 2024.

*Primary Examiner* — Kristyn A Hall
(74) *Attorney, Agent, or Firm* — Jacob M. Ward; Ward Law Office LLC

(57) ABSTRACT

A highly-sealed retrievable anchoring packer, includes a hollow tube, a blocking member, an expansion sleeve, a drive sleeve, and at least one slip assembly, and an outer side of the hollow tube is provided with a first retaining ring and a second retaining ring. By blocking an opening of the hollow tube close to the first retaining ring with the blocking member and injecting liquid into the hollow tube through another opening of the hollow tube, part of the liquid enters a cavity formed by enclosing of the drive sleeve, the first retaining ring and the hollow tube, to move the drive sleeve. Under the action of the drive sleeve, an inclined body squeezes the expansion sleeve, the expansion sleeve expands radially, and the slip member is unfolded along the inclined body, realizing the setting of the packer.

9 Claims, 6 Drawing Sheets

(56) References Cited

FOREIGN PATENT DOCUMENTS

| | | | |
|---|---|---|---|
| CN | 112211587 | B | 8/2022 |
| GB | 2377960 | B | 3/2003 |

* cited by examiner

HIGHLY-SEALED RETRIEVABLE ANCHORING PACKER

CROSS-REFERENCE TO RELATED APPLICATIONS

This application claims the benefit of Chinese Patent Application No. 202410882686.5, filed on Jul. 2, 2024, which is hereby incorporated by reference in its entirety.

TECHNICAL FIELD

The present application relates to the technical field of oilfield development, and in particular, to a highly-sealed retrievable anchoring packer.

BACKGROUND

A packer is mainly used for achieving isolation of an annular space between an oil tubing and a casing, and is widely used in engineering applications such as well-drilling, well-completion, and well-cementing, which can be used for production, water (gas) injection, inter-layer isolation and other operations.

An expandable packer used at current stage, generally requires external force to compress a slip during setting, causing the slip to deploy along an inclined surface of the corresponding arranged cone and be embedded into the well wall.

During the unsealing process of the packer, since the slip is embedded into the well wall, the retrieval is difficult, the unsealing effect is poorer, and a well sticking accident is prone to occurring.

SUMMARY

The present application provides a highly-sealed retrievable anchoring packer to solve the problem of difficult recovery of slips during the packer unsealing process.

The present application provides a highly-sealed retrievable anchoring packer, including:

- a hollow tube, provided with a first retaining ring and a second retaining ring at its outer side;
- a blocking member, configured for blocking an opening of the hollow tube close to the first retaining ring;
- an expansion sleeve, sleeved on the outer side of the hollow tube and located between the first retaining ring and the second retaining ring;
- a drive sleeve, slidably sleeved on an outer side of the first retaining ring, where a cavity is formed by enclosing of a side of the drive sleeve facing the hollow tube, a side wall of the first retaining ring and an outer wall of the hollow tube, the cavity being communicated with the hollow tube;
- at least one slip assembly, including a resilient member, and a slip member and an inclined body slidably arranged between the first retaining ring and the second retaining ring, with the slip member being connected to the inclined body, the inclined body being abutted against the expansion sleeve, and two ends of the resilient member being respectively connected to the slip member and the hollow tube.

The inclined body is configured to compress the expansion sleeve to make the slip member deploy along the inclined body when liquid enters the cavity through the hollow tube to drive the drive sleeve to move toward the second retaining ring.

The resilient member is configured to drive the slip member to reset when the hollow tube moves outward along an operation well to discharge the liquid in the cavity.

In a possible implementation, the outer wall of the hollow tube is provided with a mounting groove, and the resilient member is fixed in the mounting groove, with one end of the resilient member away from the mounting groove being connected to the slip member.

In a possible implementation, there are two slip assemblies, which are respectively located on both sides of the expansion sleeve, with each slip member being connected to a corresponding inclined body through a first shear member.

In a possible implementation, the drive sleeve is connected to the hollow tube through a second shear member, and a shear strength of the second shear member is less than a shear strength of the first shear member.

In a possible implementation, a shear strength of the first shear member close to the first retaining ring is greater than a shear strength of the first shear member close to the second retaining ring.

In a possible implementation, the drive sleeve includes a housing, a drive block and a slider, and the housing is slidably sleeved on the outer side of the first retaining ring, with one end of the housing away from the first retaining ring being connected to the slip assembly close to the first retaining ring;

- the drive block and the slider are both slidably arranged between the housing and the hollow tube, and the cavity is enclosed by the housing, the first retaining ring, the drive block and the hollow tube, with the slider being abutted against one end of the housing away from the first retaining ring, and the second shear member being sequentially connected with the drive block, the slider and the hollow tube.

In a possible implementation, the slip assembly further includes a constraint sleeve, which is slidably sleeved on the outer side of the hollow tube, and the constraint sleeve and the hollow tube are enclosed to form a mounting cavity, with the slip member being arranged in the mounting cavity and being connected to the constraint sleeve, and a slip portion of the slip member extending out of the mounting cavity to be connected to an inclined surface of the inclined body.

In a possible implementation, the outer side of the hollow tube is further sheathed with an expansion ring and a thrust ring, and the expansion ring abuts against a side of the second retaining ring facing the first retaining ring, the thrust ring is connected to the slip assembly close to the second retaining ring, and the thrust ring abuts against a side of the expansion ring away from the second retaining ring.

In a possible implementation, at least two layers of protection members are provided between the inclined body and the expansion sleeve.

In a possible implementation, the expansion sleeve includes a plurality of expansion members slidably sleeved on the outer side of the hollow tube, two adjacent expansion members are separated by a spacer ring, and two inclined bodies are respectively connected to the corresponding expansion members.

The highly-sealed retrievable anchoring packer provided by the present application includes a hollow tube, a blocking member, an expansion sleeve, a drive sleeve, and at least one slip assembly, and an outer side of the hollow tube is provided with a first retaining ring and a second retaining ring. By blocking an opening of the hollow tube close to the first retaining ring with the blocking member and injecting liquid into the hollow tube through another opening of the hollow tube, part of the liquid enters a cavity formed by enclosing the drive sleeve, the first retaining ring and the hollow tube, to move the drive sleeve. Under the action of the drive sleeve, an inclined body squeezes the expansion sleeve, the expansion sleeve expands radially, and the slip member unfolds along the inclined body, realizing the setting of the packer. When the packer is unset, liquid injection is terminated and the hollow tube is pulled outward along the operation well to discharge the liquid from the cavity. The slip member is reset under the action of the resilient member, so that the packer can be quickly unset for easy recovery, thereby avoiding well sticking accidents.

DRAWINGS

The drawings, which are incorporated into the specification and constitute a part of the present specification, illustrate embodiments consistent with the present application and, together with the description, serve to explain the principles of the present application.

DESCRIPTION OF REFERENCE SIGNS

Figure 1:
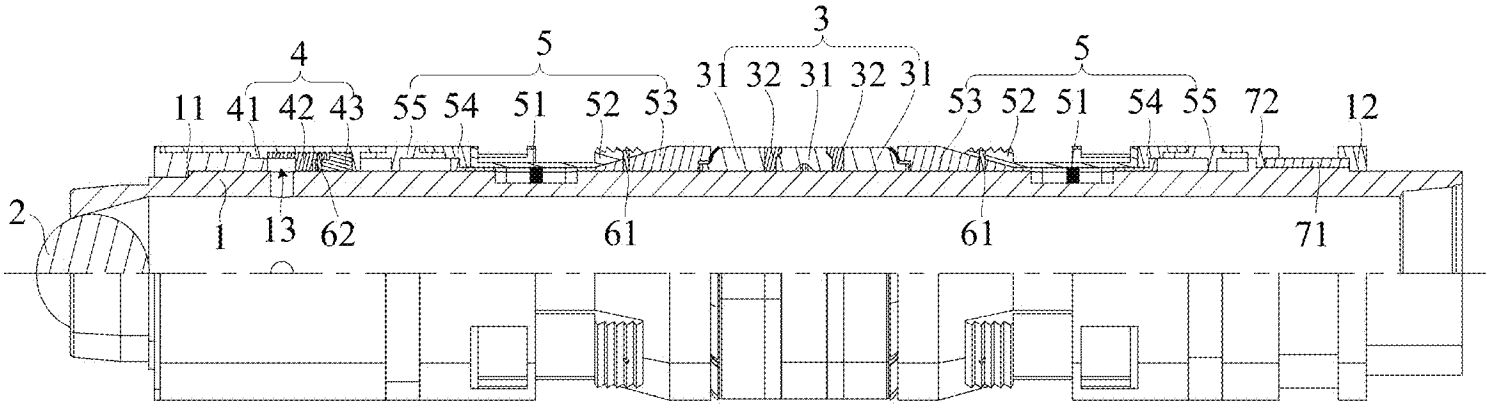
FIG. 1 is a schematic diagram of a cross-sectional structure of a packer provided by an embodiment of the present application.

1—hollow tube; 11—first retaining ring; 12—second retaining ring; 13—cavity; 14—mounting groove;
2—blocking member;
3—expansion sleeve; 31—expansion member; 32—spacer ring;
4—drive sleeve; 41—housing; 42—drive block; 43—slider;
5—slip assembly; 51—resilient member; 52—slip member; 53—inclined body; 54—constraint sleeve; 55—slip ring; 56—slip portion;
61—first shear member; 62—second shear member;
71—expansion ring; 72—thrust ring;
8—protection member.

Definite embodiments of the present application have been shown by the above-described drawings, which will be described in more detail later. These drawings and textual descriptions are not intended to limit the scope of the conception of the present application in any way, but rather to illustrate the concepts of the present application for the person skilled in the art by referring to specific embodiments.

DESCRIPTION OF EMBODIMENTS

Exemplary embodiments will be described in detail herein, examples of which are shown in the drawings. When the following description refers to the drawings, unless otherwise indicated, the same numbers in different drawings represent the same or similar elements. The implementations described in the following exemplary embodiments do not represent all implementations consistent with the present application. On the contrary, they are merely examples of devices and methods consistent with some aspects of the present application as detailed in the appended claims.

As demonstrated in the background art, in the case of production well, the production layer needs to be sealed during the production process, by squeezing a rubber sleeve to make it to expand to the inner wall of the production well casing. A packer generally requires external force to squeeze the slip during setting, causing the slip to unfold along the inclined surface of the corresponding cone and become embedded into the well wall. During the unsealing process of the packer, since the slip is embedded into the well wall, it is more difficult for slip recovery and quick unsealing, and prone to the occurrence of a well sticking accident.

Based on this, a highly-sealed retrievable anchoring packer provided by the present application includes a hollow tube, a blocking member, an expansion sleeve, a drive sleeve, and at least one slip assembly, and an outer side of the hollow tube is provided with a first retaining ring and a second retaining ring. By blocking an opening of the hollow tube close to the first retaining ring with a blocking member and injecting liquid into the hollow tube through another opening of the hollow tube, part of the liquid enters a cavity formed by enclosing the drive sleeve, the first retaining ring and the hollow tube, to move the drive sleeve. Under the action of the drive sleeve, an inclined body squeezes the expansion sleeve, the expansion sleeve expands radially, and the slip member unfolds along the inclined body, realizing the setting of the packer. When the packer is unsealed, liquid injection is terminated and the hollow tube is pulled outward along the operation well to discharge the liquid from the cavity. The slip member is reset under the action of the resilient member, so that the packer can be quickly unsealed for easy recovery, thereby avoiding well sticking accidents.

The technical solutions of the present application and how the technical solutions of the present application solve the above-mentioned technical problems are described in detail below with specific embodiments. The following specific embodiments may be combined with each other, and the same or similar concepts or processes may not be repeated in some embodiments. The embodiments of the present application will be described below in conjunction with the drawings.

Referring to FIG. 1, the present application provides a highly-sealed retrievable anchoring packer, which includes a hollow tube 1, a blocking member 2, an expansion sleeve 3, a drive sleeve 4 and at least one slip assembly 5, and an outer side of the hollow tube 1 is provided with a first retaining ring 11 and a second retaining ring 12.

The blocking member 2 is used for blocking an opening of the hollow tube 1 close to the first retaining ring 11.

The expansion sleeve 3 is sleeved on the outer side of the hollow tube 1 and is located between the first retaining ring 11 and the second retaining ring 12.

The drive sleeve 4 is slidably sleeved on the outer side of the first retaining ring 11, and a cavity 13 is formed by enclosing of a side of the drive sleeve 4 facing the hollow tube 1, a side wall of the first retaining ring 11 and an outer wall of the hollow tube 1, with the cavity 13 being communicated with the hollow tube 1.

The slip assembly 5 includes a resilient member 51, and a slip member 52 and an inclined body 53 which are slidably arranged between the first retaining ring 11 and the second retaining ring 12. The slip member 52 is connected to the inclined body 53, the inclined body 53 abuts against the expansion sleeve 3, and two ends of the resilient member 51 are respectively connected to the slip member 52 and the hollow tube 1.

The inclined body 53 is configured to squeeze the expansion sleeve 3 when the liquid enters the cavity 13 through the hollow tube 1 to drive the drive sleeve 4 to move toward the second retaining ring 12, so that the slip member 52 is unfolded along the inclined body 53.

The resilient member 51 is configured to drive the slip member 52 to reset when the hollow tube 1 moves outward along the operation well to discharge the liquid in the cavity 13.

Figure 2:
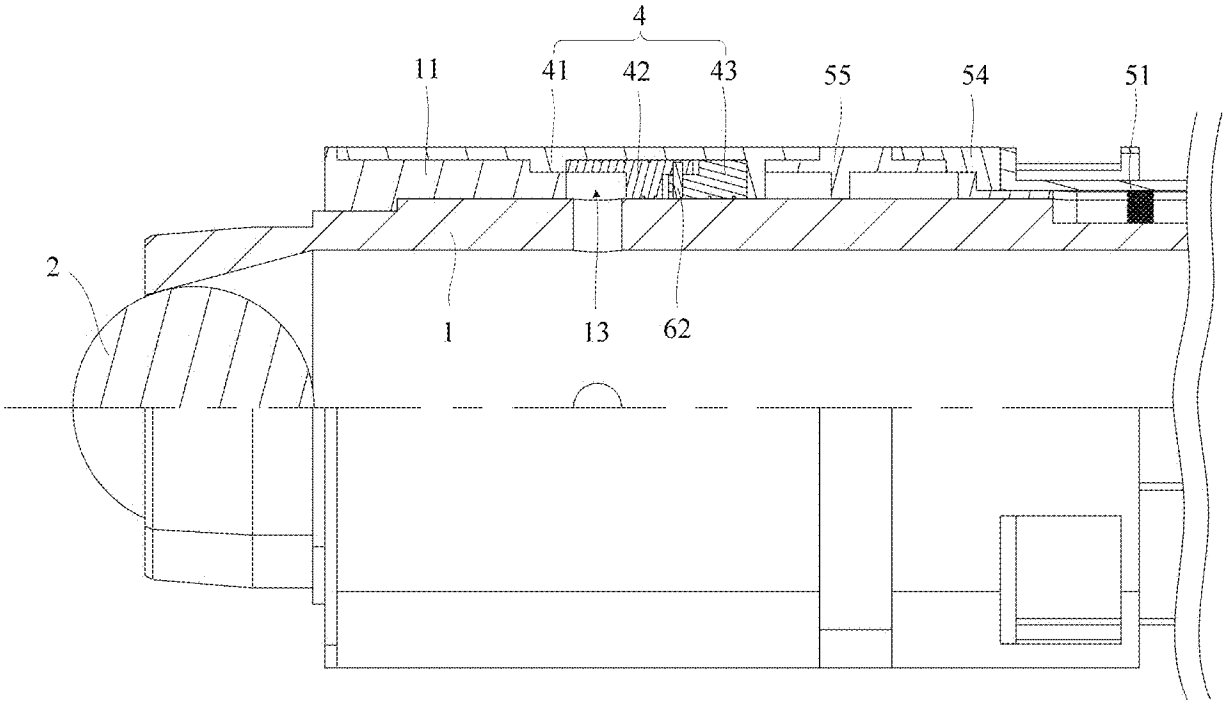
FIG. 2 is a schematic diagram of a cross-sectional structure of a drive sleeve and a slip assembly in a packer provided by an embodiment of the present application.

Specifically, referring to FIG. 1 and FIG. 2, the opening of the hollow tube 1 close to the first retaining ring 11 is a liquid outlet opening, and the opening of the hollow tube 1 close to the second retaining ring 12 is a liquid inlet opening. After the packer is lowered into a well and reaches the designated position, the liquid outlet opening is blocked by the blocking member 2, and liquid is injected into the hollow tube 1 through the liquid inlet opening, and part of the liquid can enter the cavity 13 enclosed by the drive sleeve 4, the first retaining ring 11 and the hollow tube 1, from the hollow tube 1. As the hydraulic pressure in the cavity 13 increases, the drive sleeve 4 can slide toward the second retaining ring 12 along an axial direction of the hollow tube 1, and thereby drive the slip member 52 and the inclined body 53 to slide toward the second retaining ring 12. Under the action of the drive sleeve 4, the inclined body 53 squeezes the expansion sleeve 3 so that the expansion sleeve 3 expands radially to the well wall to achieve sealing between the packer and the well wall. In addition, the slip unfolds outward along the inclined body 53 to make the slip embedded into the well wall to set the packer. At the same time, during the movement of the slip relative to the hollow tube 1, the resilient member 51 is gradually stretched, and after the packer is set, the resilient member 51 is in a state of energy storage. Then, the blockage of the liquid outlet opening by the blocking member 2 is released to make a smooth communication between the hollow tube 1 and an external pipeline.

When the packer is unsealed, the liquid injection is terminated, and the hollow tube 1 is pulled outward along the operation well. The hollow tube 1 moves with respect to the drive sleeve 4, the volume of the cavity 13 gradually decreases, and the liquid in the cavity 13 is discharged, with the force from the drive sleeve 4 on the slip assembly 5 and the expansion sleeve 3 being gradually reduced. Under the action of the resilient member 51, the slip member 52 is quickly reset, the expansion sleeve 3 shrinks, and the unsetting of packer is completed, avoiding the occurrence of a well sticking accident.

Where, it can be understood that the expansion sleeve 3 is pressed by the inclined body 53 so that the expansion sleeve 3 expands radially and clings to the well wall of the operation well, thereby improving the sealing performance between the packer and the well wall.

It can be understood that both ends of the hollow tube 1 may be respectively threadedly connected with an external joint or a drill rod, thereby facilitating the liquid injection into the hollow tube 1.

Further, referring to FIG. 1 and FIG. 2, the blocking member 2 may be a small ball, and the inner diameter of the liquid outlet opening gradually decreases outward from the hollow tube 1. The small ball enters the hollow tube 1 from the liquid inlet opening and is stuck at the liquid outlet opening. After the packer is set by the slip assembly 5, as the hydraulic pressure in the hollow tube 1 increases, the small ball breaks through the liquid outlet opening to make a smooth communication between the hollow tube 1 and the external pipeline.

Further, the expansion sleeve 3 may be a rubber sleeve commonly used in the art, which is not limited here.

Further, the resilient member 51 may be a spring.

In some embodiments, the cavity 13 enclosed by the drive sleeve 4, the first retaining ring 11 and the hollow tube 1 is an annular structure, so that the drive sleeve 4 has sufficient power to drive the slip member 52 and the inclined body 53 to move.

In some embodiments, referring to FIG. 1 and FIG. 2, the outer wall of the hollow tube 1 is provided with a mounting groove 14, and a resilient member 51 is fixed in the mounting groove 14, with one end of the resilient member 51 away from the mounting groove 14 being connected to the slip member 52. The resilient member 51 is mounted in the mounting groove 14, ensuring the slip member 52 is in a retracted state before the packer is set, and also avoiding interference with the movement of the slip member 52.

Further, referring to FIG. 1 and FIG. 2, a plurality of resilient members 51 may be provided. The plurality of resilient members 51 are arranged along the circumference of the hollow tube 1 to provide sufficient resilient force for the slip member 52. Of course, it can be understood that a plurality of mounting grooves may also be provided, and the plurality of resilient members 51 are arranged in a one-to-one correspondence in the plurality of mounting grooves.

In some embodiments, referring to FIG. 1 and FIG. 2, the packer may have only one slip assembly 5, which is located between the first retaining ring 11 and the expansion sleeve 3. The slip member 52 is connected to the drive sleeve 4, the inclined body 53 is abutted against the expansion sleeve 3, and the slip member 52 and the inclined body 53 are pushed to move by the drive sleeve 4.

In some embodiments, referring to FIG. 1 to FIG. 4, the packer may include two slip assemblies 5, which are respectively located on both sides of the expansion sleeve 3, and each slip member 52 is connected to the corresponding inclined body 53 through a first shear member 61.

Further, in the slip assembly 5 located between the expansion sleeve 3 and the first retaining ring 11, the slip member 52 is connected to the drive sleeve 4, and the inclined body 53 abuts against the expansion sleeve 3. In the slip assembly 5 located between the expansion sleeve 3 and the second retaining ring 12, the slip member 52 abuts against the second retaining ring 12, and the inclined body 53 abuts against the expansion sleeve 3.

By arranging the slip assemblies 5 on both sides of the expansion sleeve 3 respectively, when the packer is set, the slip members 52 in the two slip assemblies 5 are respectively embedded into the well wall, so that the packer is bidirectionally anchored, ensuring the stability of the setting of the packer. When the packer is unset, the resilient member 51 in each of the two slip assemblies 5 quickly resets its corresponding slip member 52.

When the existing packer is used in a highly-deviated well or a horizontal well, the packer is subjected to complex forces during the process of being lowered into the well, and the slip assembly 5 is extremely susceptible to forces, resulting in the slip member 52 being set midway.

Figure 3:
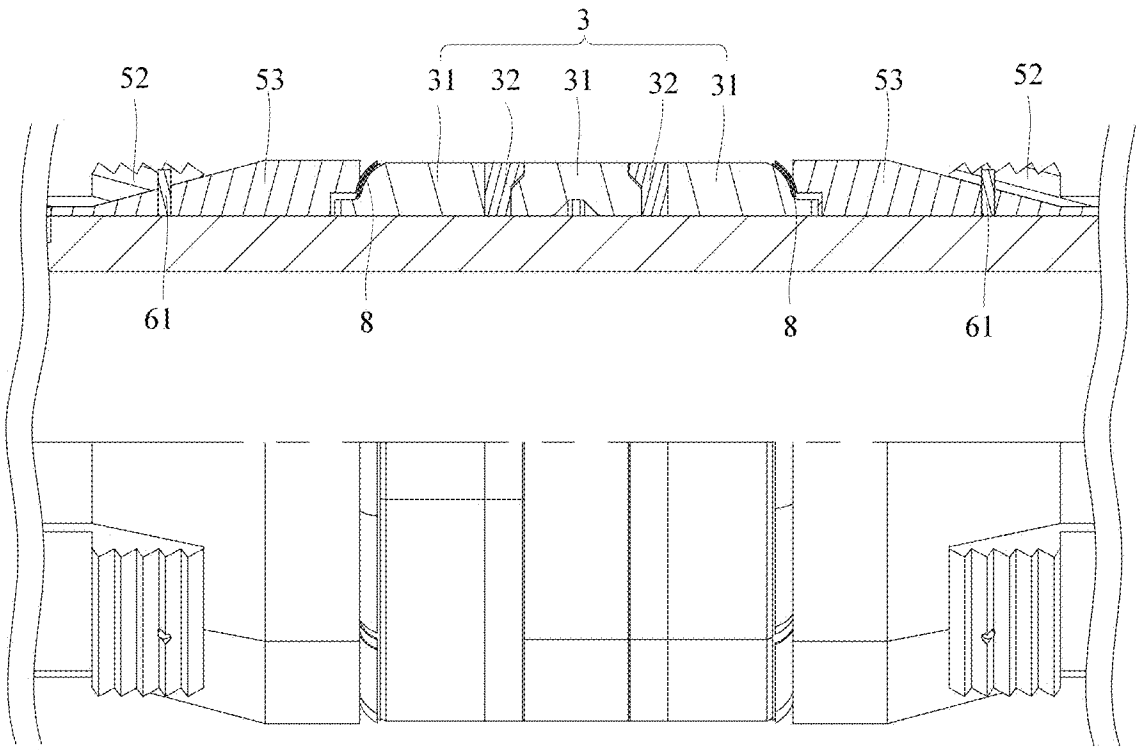
FIG. 3 is a schematic diagram of a cross-sectional structure of an expansion sleeve and a slip assembly in a packer provided by an embodiment of the present application.

Further, referring to FIG. 1 and FIG. 3, a slip portion 56 of each slip member 52 is connected to the inclined surface of the corresponding inclined body 53 through a first shear member 61. The first shear member 61 is mainly used for limiting the relative movement between the slip member 52 and the inclined body 53 when the packer is lowered into the well, preventing the packer from being set prematurely before reaching the designated position. As the hydraulic pressure in the hollow tube 1 and the cavity 13 increases, the first shear member 61 is sheared off under the action of the drive sleeve 4, so that the slip member 52 can be unfolded along the inclined surface of the inclined body 53 to set the packer.

Exemplarily, the first shear member 61 may be a shear pin.

In some embodiments, referring to FIG. 1 and FIG. 2, the drive sleeve 4 is connected to the hollow tube 1 through a second shear member 62, and a shear strength of the second shear member 62 is less than a shear strength of the first shear member 61.

The second shear member 62 is mainly used for limiting the relative movement between the drive sleeve 4 and the hollow tube 1, preventing the drive sleeve 4 from being forced to move relative to the hollow tube 1 and pushing the slip assembly 5, when the packer is lowered into the well, so that the expansion sleeve 3 expands prematurely under the compression of the slip assembly 5, resulting in friction between the expanded expansion sleeve 3 and the well wall, which causes damage to the expansion sleeve 3. At the same time, it can also prevent the packer from being set prematurely before reaching the designated position.

Further, the shear strength of the second shear member 62 is less than the shear strength of the first shear member 61. After the hollow tube 1 is fed with liquid, the hydraulic pressure in the cavity 13 increases, and the first shear member is firstly sheared off under force to make the drive sleeve 4 move relative to the hollow tube 1; then, as the hydraulic pressure in the cavity 13 increases, the second shear member 62 is sheared off under force, so that the inclined body 53 squeezes the expansion sleeve 3, and the slip member 52 is unfolded along the inclined body 53.

Exemplarily, the second shear member 62 may also be a shear pin.

In some embodiments, the shear strength of the first shear member 61 close to the first retaining ring 11 is greater than the shear strength of the first shear member 61 close to the second retaining ring 12.

It can be understood that the two first shear members 61 are sheared off successively, so that the slip member 52 close to the second retaining ring 12 first unfolds along its corresponding inclined body 53 and the packer forms a preliminary setting, and finally the slip member 52 close to the first retaining ring 11 is unfolded along its corresponding inclined body 53, and the packer completes the setting.

Further, the shear strength of the second shear member 62 is less than the shear strength of the first shear member 61, and the shear strength of the first shear member 61 close to the first retaining ring 11 is greater than the shear strength of the first shear member 61 close to the second retaining ring 12.

Referring to FIG. 1 to FIG. 4, after the hollow tube 1 is fed with liquid, the hydraulic pressure in the cavity 13 increases, and the first shear member is first sheared off under force, to make the drive sleeve 4 move relative to the hollow tube 1. As the hydraulic pressure in the cavity 13 increases, under the action of the drive sleeve 4, the first shear member 61 close to the second retaining ring 12 is sheared off, causing the slip member 52 close to the second retaining ring 12 to unfold along the inclined surface of its corresponding inclined body 53, forming a preliminary setting of the packer. Then, under the action of the drive sleeve 4, the slip member 52 and the inclined body 53 which are close to the first retaining ring 11 move toward the second retaining ring 12 and squeeze the expansion sleeve 3 by the inclined body 53 to make it expand radially to the well wall, achieving the sealing between the packer and the well wall. Finally, as the hydraulic pressure in the cavity 13 increases, the first shear member 61 close to the first retaining ring 11 is sheared off, so that the slip member 52 close to the first retaining ring 11 is unfolded along the inclined surface of its corresponding inclined body 53, finishing the setting of the packer.

The highly-sealed retrievable anchoring packer provided by the present application adopts an integrated structure with a simple overall structure. By the arrangement of the second shear member 62 and the two first shear members 61, it is possible to prevent the slip member 52 from unfolding along the inclined body 53 midway and avoid the expansion sleeve 3 expanding radically midway, so as to prevent the midway setting of the packer when it is lowered into the well. In addition, under the action of hydraulic pressure, the second shear member 62 and the two first shear members 61 are sheared off in sequence, so that the packer is bidirectionally anchored and set in the operation well. After replacing the corresponding second shear member 62 and the two first shear members 61, the packer can be reused again.

In some embodiments, referring to FIG. 1 and FIG. 2, the drive sleeve 4 includes a housing 41, a drive block 42 and a slider 43. The housing 41 is slidably sleeved on the outer side of the first retaining ring 11, and one end of the housing 41 away from the first retaining ring 11 is connected to the slip assembly 5 close to the first retaining ring 11.

The drive block 42 and the slider 43 are both slidably arranged between the housing 41 and the hollow tube 1. A cavity 13 is formed by collective enclosing with the housing 41, the first retaining ring 11, the drive block 42 and the hollow tube 1. The slider 43 abuts against one end of the housing 41 away from the first retaining ring 11. The second shear member 62 is sequentially connected with the drive block 42, the slider 43 and the hollow tube 1.

As the hydraulic pressure in the cavity 13 increases, the drive block 42 moves along the axial direction of the hollow tube I toward the second retaining ring 12, to shear off the second shear member 62 between the drive block 42 and the slider 43, and push the slider 43 and the housing 41 to move, and the housing 41 drives the slip assembly 5 to move.

Further, sealing rings are provided between the drive block 42 and the housing 41, between the drive block 42 and the hollow tube 1, and between the housing 41 and the first retaining ring 11, so as to prevent liquid leakage from the cavity 13.

Figure 4:
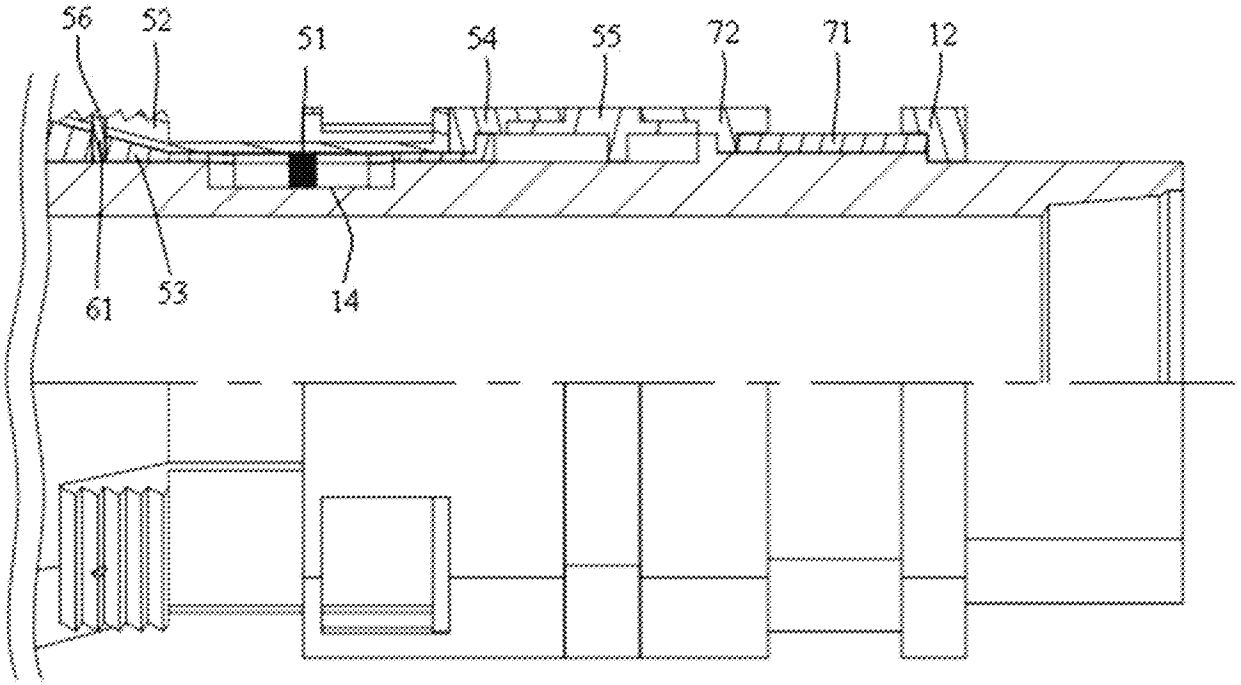
FIG. 4 is a schematic diagram of a cross-sectional structure of a slip assembly and a second retaining ring in a packer provided by an embodiment of the present application.

In some embodiments, referring to FIG. 1, FIG. 2 and FIG. 4, the slip assembly 5 further includes a constraint sleeve 54, which is slidably sleeved on the outer side of the hollow tube 1, and a mounting cavity is formed by the constraint sleeve 54 and the hollow tube 1 through enclosing together. The slip member 52 is arranged in the mounting cavity and is connected to the constraint sleeve 54, and the slip portion 56 of the slip member 52 extends out of the mounting cavity and is connected to the inclined surface of the inclined body 53. The constraint sleeve 54 is mainly used for constraining the unfolding extent of the slip member 52, preventing damage to both the slip member 52 and the resilient member 51.

In some embodiments, referring to FIG. 1 and FIG. 4, the outer side of the hollow tube 1 is further sleeved with an expansion ring 71 and a thrust ring 72. The expansion ring 71 abuts against a side of the second retaining ring 12 facing the first retaining ring 11, the thrust ring 72 is connected to the slip assembly 5 close to the second retaining ring 12, and the thrust ring 72 abuts against a side of the expansion ring 71 away from the second retaining ring 12.

Since the slip member 52 in the slip assembly 5 is limited to the inclined surface of the inclined body 53 by the first shear member 61, when the drive sleeve 4 is moved, it will drive the slip member 52, the inclined body 53 and the expansion sleeve 3 to move toward the second retaining ring 12, and squeeze the expansion ring 71 through the thrust ring 72, so that the expansion ring 71 radially expands and contacts the well wall to form a preliminary setting, preventing debris from falling down during subsequent work and affecting the operation of the expansion sleeve 3 and the slip assembly 5.

Exemplarily, the expansion ring 71 may be a rubber ring.

Further, referring to FIG. 1, FIG. 2 and FIG. 4, the slip assembly 5 further includes a slip ring 55, one end of which is threadedly connected to the constraint sleeve 54. The outer side of the hollow tube 1 is provided with a limiting groove, and the slip ring 55 is sleeved in the limiting groove, and the slip ring 55 can slide in the limiting groove along the axial direction of the hollow tube 1. Where, the slip ring 55 close to the first retaining ring 11 is threadedly connected to the housing 41, and the slip ring 55 close to the second retaining ring 12 is threadedly connected to the thrust ring 72.

By means of the slip ring 55 and the limiting groove, the movement distance of the slip member 52 along the hollow tube 1 is constrained, thereby reducing the damage to the slip member 52.

Further, referring to FIG. 1 and FIG. 4, a convex ring is arranged between the first retaining ring 11 and the second retaining ring 12, and the convex ring is close to the second retaining ring 12. The thrust ring 72 is slidably arranged between the convex ring and the second retaining ring 12, and the expansion ring 71 is clamped between the thrust ring 72 and the second retaining ring 12.

Figure 5:
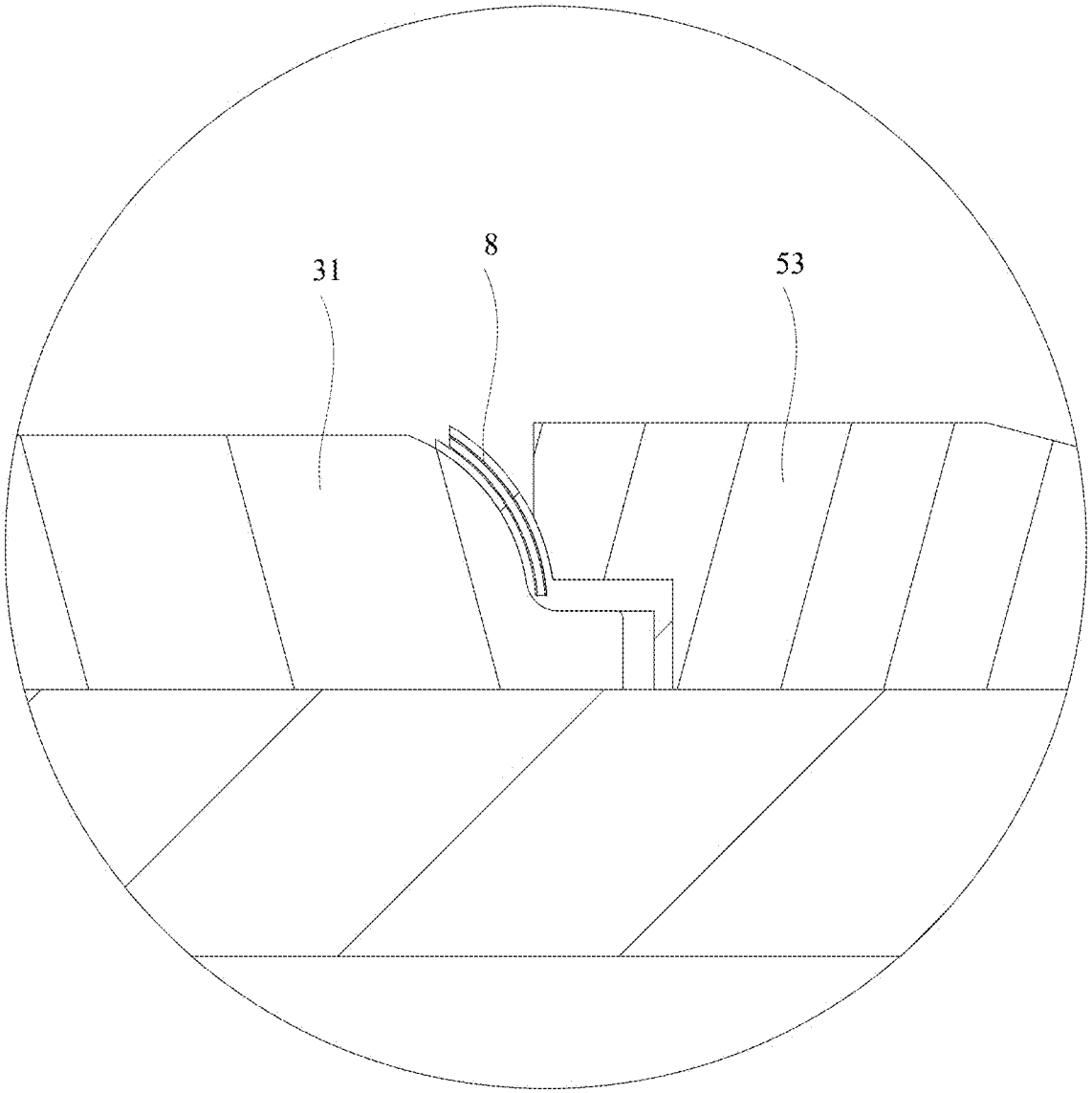
FIG. 5 is a schematic diagram of a cross-sectional structure of an inclined body and an expansion sleeve in a packer provided by an embodiment of the present application.

In some embodiments, referring to FIG. 3 and FIG. 5, at least two layers of protection members 8 are arranged between the inclined body 53 and the expansion sleeve 3. By arranging at least two layers of protection members 8, the expansion sleeve 3 is constrained from deformation when the inclined body 53 pressurizes the expansion sleeve 3, thereby preventing the occurrence of "shoulder protrusion" phenomenon in the expansion sleeve 3.

Further, the protection members 8 on two adjacent sides are fixed by welding points, and the structure of multi-layer protection member 8 can constrain the deformation of the expansion sleeve 3 under different loads. When the load is small, the shape of the protection member 8 remains unchanged. When the load increases, the welding points of the first layer of the protection member 8 (the first layer is a layer close to the inclined body 53) are disconnected, and the thin sheet of the first layer of the protection member 8 is expanded. When the load continues to increase, the thin sheet of the second layer of the protection member 8 is expanded, and so on. The structural design of the protection member 8 can not only reduce the occurrence of the "shoulder protrusion" phenomenon of the expansion sleeve 3, but also constrain the deformation of the expansion sleeve 3 based on different load conditions.

Specifically, the multi-layer protection member 8 is threadedly connected to one end of the inclined body 53 close to the expansion sleeve 3.

In some embodiments, referring to FIG. 1 and FIG. 3, the expansion sleeve 3 includes a plurality of expansion members 31 which are slidably sleeved on the outer side of the hollow tube 1. Two adjacent expansion members 31 are separated by a spacer ring 32, and the two inclined bodies 53 are respectively connected to corresponding expansion members 31.

The sealing performance of the packer can be further improved by providing a plurality of expansion members 31. At the same time, compared with a single rubber sleeve, it can be ensured that at least one expansion member 31 is not damaged in the event that the packer inevitably comes into frictional contact with the well wall when being lowered into the well, so that the packer can achieve a sealing effect.

Exemplarily, referring to FIG. 1 and FIG. 3, the expansion sleeve 3 includes three expansion members 31. The expansion member 31 may be a rubber sleeve.

Figure 6:
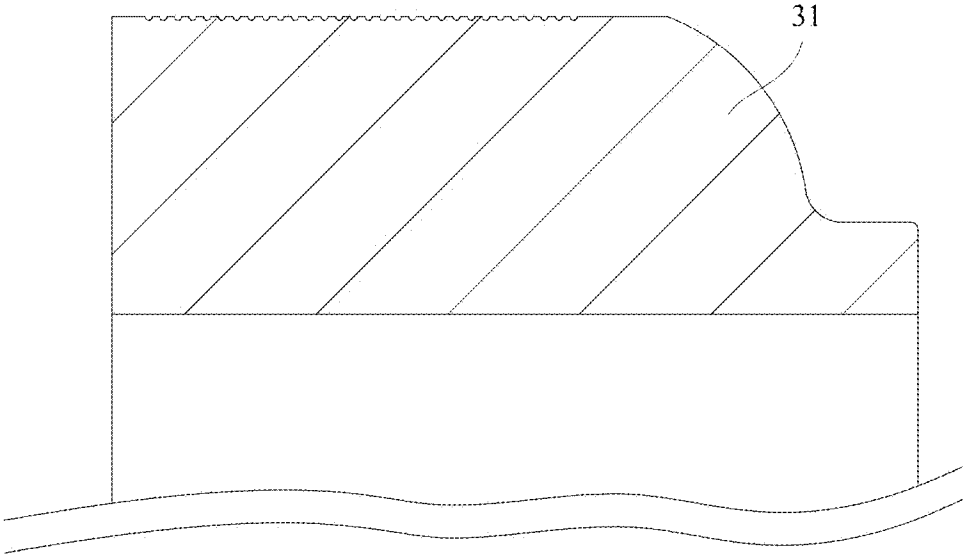
FIG. 6 is a schematic diagram of a cross-sectional structure of an expansion member in a packer provided by an embodiment of the present application.

Further, referring to FIG. 6, the plurality of expansion members 31 all adopt a semicircular contour structure, which can further improve the contact force with the well wall compared to a conventional rubber sleeve, thereby improving the sealing performance of the packer.

Further, referring to FIG. 6, the outer surfaces of the plurality of expansion members 31 are all concave-convex surfaces to increase the contact force with the well wall.

Other embodiments of the present application will readily occur to the person skilled in the art upon consideration of the specification and practice of the embodiments disclosed herein. The present application is intended to cover any modifications, uses or adaptive changes of the present application, which follow the general principles of the present application and include common knowledge or commonly used technical means in the technical filed of the present application that are not disclosed in the present application. The description and embodiments are intended to be exemplary only, and the true scope and spirit of the present application are indicated by the following claims.

It should be understood that the present application is not limited to the precise structures that have been described above and shown in the drawings, and various modifications and changes may be made without departing from the scope thereof. The scope of the present application is limited only by the appended claims.

What is claimed is:

1. A highly-sealed retrievable anchoring packer, comprising:

a hollow tube, an outer side of the hollow tube being provided with a first retaining ring and a second retaining ring;

a blocking member, configured for blocking an opening of the hollow tube close to the first retaining ring;

an expansion sleeve, sleeved on the outer side of the hollow tube and located between the first retaining ring and the second retaining ring;

a drive sleeve, slidably sleeved on an outer side of the first retaining ring, wherein a cavity is formed by enclosing of a side of the drive sleeve facing the hollow tube, a side wall of the first retaining ring and an outer wall of the hollow tube, the cavity being communicated with the hollow tube; and at least one slip assembly, comprising a resilient member, and a slip member and an inclined body slidably arranged between the first retaining ring and the second retaining ring, the slip member being connected to the inclined body, the inclined body being configured to pressurize the expansion sleeve to make the expansion sleeve expand radially, and two ends of the resilient member being respectively connected to the slip member and the hollow tube;

wherein the inclined body is configured to squeeze the expansion sleeve to make the slip member slide along the inclined body to expand forward when liquid enters the cavity through the hollow tube to drive the drive sleeve to move toward the second retaining ring;

the resilient member is configured to drive the slip member to reset when the hollow tube moves longitudinally upward along an operation well to discharge the liquid in the cavity, wherein the outer wall of the hollow tube is provided with a mounting groove, and the resilient member is fixed in the mounting groove, with one end of the resilient member away from the mounting groove being connected to the slip member.

2. The packer according to claim 1, wherein the slip assembly is two in number, and the two slip assemblies are respectively located on both sides of the expansion sleeve, with each slip member being connected to a corresponding inclined body through a first shear member.

3. The packer according to claim 2, wherein the outer side of the hollow tube is further sheathed with an expansion ring and a thrust ring, and the expansion ring abuts against one side of the second retaining ring facing the first retaining ring, the thrust ring is connected to the slip assembly close to the second retaining ring, and the thrust ring abuts against one side of the expansion ring away from the second retaining ring.

4. The packer according to claim 2, wherein at least two layers of protection members are provided between the inclined body and the expansion sleeve.

5. The packer according to claim 2, wherein the drive sleeve is connected to the hollow tube through a second shear member, and a shear strength of the second shear member is less than a shear strength of the first shear member.

6. The packer according to claim 5, wherein the drive sleeve comprises a housing, a drive block and a slider, and the housing is slidably sleeved on the outer side of the first retaining ring, with one end of the housing away from the first retaining ring being connected to the slip assembly close to the first retaining ring;

the drive block and the slider are both slidably arranged between the housing and the hollow tube, and the cavity is formed by enclosing of the housing, the first retaining ring, the drive block and the hollow tube, with the slider being abutted against one end of the housing away from the first retaining ring, and the second shear member being sequentially connected with the drive block, the slider and the hollow tube.

7. The packer according to claim 5, wherein a shear strength of the first shear member close to the first retaining ring is greater than a shear strength of the first shear member close to the second retaining ring.

8. The packer according to claim 7, wherein the drive sleeve comprises a housing, a drive block and a slider, and the housing is slidably sleeved on the outer side of the first retaining ring, with one end of the housing away from the first retaining ring being connected to the slip assembly close to the first retaining ring;

the drive block and the slider are both slidably arranged between the housing and the hollow tube, and the cavity is formed by enclosing of the housing, the first retaining ring, the drive block and the hollow tube, with the slider being abutted against one end of the housing away from the first retaining ring, and the second shear member being sequentially connected with the drive block, the slider and the hollow tube.

9. The packer according to claim 8, wherein the expansion sleeve comprises a plurality of expansion members slidably sleeved on the outer side of the hollow tube, two adjacent expansion members of the plurality of expansion members are separated by a spacer ring, and two inclined bodies are respectively connected to corresponding expansion members.

* * * * *